US007065292B2

(12) United States Patent
Thweatt, Jr.

(10) Patent No.: US 7,065,292 B2
(45) Date of Patent: Jun. 20, 2006

(54) ELECTRIC WATER HEATER

(75) Inventor: Carlisle Thweatt, Jr., South Haven, MI (US)

(73) Assignee: Global Heating Solutions, Inc., Allegan, MI (US)

( * ) Notice: Subject to any disclaimer, the term of this patent is extended or adjusted under 35 U.S.C. 154(b) by 65 days.

(21) Appl. No.: 11/048,187

(22) Filed: Feb. 1, 2005

(65) Prior Publication Data

US 2005/0129391 A1 Jun. 16, 2005

Related U.S. Application Data

(63) Continuation of application No. 09/827,232, filed on Apr. 5, 2001, now Pat. No. 6,873,793.

(51) Int. Cl.
*F24H 1/10* (2006.01)

(52) U.S. Cl. ..... 392/488; 219/546

(58) Field of Classification Search ..... 392/487, 392/488, 489; 219/538, 544, 546, 548, 552
See application file for complete search history.

(56) References Cited

U.S. PATENT DOCUMENTS

| | | | | |
|---|---|---|---|---|
| 2,775,683 | A | 12/1956 | Kleist | |
| 3,088,017 | A | 4/1963 | Schomann | |
| 3,835,294 | A | 9/1974 | Krohn et al. | |
| 3,890,143 | A | 6/1975 | Skoglund et al. | |
| 4,085,308 | A | 4/1978 | Youngquist | |
| 4,182,948 | A | 1/1980 | Markum et al. | |
| 4,185,187 | A | 1/1980 | Rogers | |
| 4,308,636 | A | 1/1982 | Davis | |
| 4,762,980 | A | 8/1988 | Insley | |
| 4,924,069 | A | 5/1990 | Giordani | |
| 5,220,638 | A | 6/1993 | Moore et al. | |
| 5,396,574 | A | 3/1995 | Base et al. | |
| 5,536,478 | A | 7/1996 | Lipp et al. | |
| 5,875,283 | A | 2/1999 | Yane et al. | |
| 5,963,580 | A | 10/1999 | Eckert | |
| 5,978,550 | A | 11/1999 | Rochelle | |
| 6,080,973 | A | 6/2000 | Thweatt, Jr. | |
| 6,131,237 | A | 10/2000 | Kasper et al. | |
| 6,192,549 | B1 | 2/2001 | Kasen et al. | |
| 6,621,985 | B1 | 9/2003 | Thweatt, Jr. | |
| 6,873,793 | B1 * | 3/2005 | Thweatt, Jr. | 392/488 |
| 2002/0146244 | A1 | 10/2002 | Thweatt, Jr. | |

OTHER PUBLICATIONS

"Tubular Heaters", Ogden Manufacturing Co., www.ogdenmfg.com.

* cited by examiner

*Primary Examiner*—Thor S. Campbell
(74) *Attorney, Agent, or Firm*—Price, Heneveld, Cooper, DeWitt & Litton, LLP

(57) ABSTRACT

An electrical heater for fluid including a generally tubular housing have a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

20 Claims, 2 Drawing Sheets

ELECTRIC WATER HEATER

CROSS-REFERENCE TO RELATED APPLICATION

The present application is a continuation of U.S. application Ser. No. 09/827,232, filed Apr. 5, 2001, now issued U.S. Pat. No. 6,873,793, the entire contents of which are incorporated by reference.

BACKGROUND OF THE INVENTION

Electric flow-through water heaters are commonly employed for use in heating circulating water for use with a spa/hot tub and other applications. Electric flow-through water heaters commonly employ an electrical heating element disposed in a metallic vessel such that the heating element is in contact with the flow of water to provide heat exchange to the water as it flows along the heating element. In addition, a water pump is generally used to continuously circulate water through the heater vessel. In the conventional water heating system, a thermostat is typically disposed within the hollow of the vessel to sense the temperature of the heated water, and the heating element is generally controlled based on the sensed water temperature. According to many conventional approaches, the electric heater is controlled in response to the sensed temperature of the water to maintain a desired water temperature.

Modern pools, spas and the like may utilize a variety of chemicals in the water to prevent growth of bacteria or other undesirable organisms. Such chemicals may be highly reactive/corrosive, thus limiting the life of the heater element when exposed to the water and chemicals. Although stainless steel is corrosion resistant, the highly reactive nature of the chemicals degrades even known stainless steel heater elements. Known heater elements include a tubular stainless steel outer jacket with an inner conductive wire extending through the outer jacket. A dielectric insulation such as magnesium oxide or other suitable dielectric medium is disposed around the inner conductive wire to permit transfer of heat from the inner conductive wire to the outer jacket, while providing electrical insulation between the inner conductive wire and the outer jacket. The magnesium oxide or other powder is packed tightly to promote heat conduction from the inner conductive wire to the stainless outer jacket. In an attempt to alleviate the corrosion problems caused by the water and corrosive chemicals, a titanium outer sleeve material has been tried. However, the high temperatures of the heating element cause the titanium to stress relieve, thus significantly reducing the compaction and heat conduction capability of the magnesium oxide.

Accordingly, a heating element that alleviates the problems associated with prior heating elements would be desired.

SUMMARY OF THE INVENTION

One aspect of the present invention is an electrical heater for fluid including a generally tubular housing have a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

Another aspect of the present invention is an electrical heating element including an outer sheath made of a titanium material, and an inner sheath made of a stainless steel material. The electrical heating element has an electrical resistance line disposed within the inner sheath, the electrical heating element including a dielectric powder disposed within the inner sheath around the electrical resistance line. The outer sheath and the inner sheath are tightly rolled to compress the dielectric powder around the electrical resistance line.

Yet another aspect of the present invention is a method of fabricating an electrical heating element. The method includes providing an electrical resistance heating line, and placing the electrical resistance heating line in a stainless steel sheath. Dielectric powder is positioned around the electrical resistance heating line, and a titanium sheath is placed over the stainless steel sheath. The titanium and stainless steels sheaths are compacted to compress the dielectric powder around the heating line.

Yet another aspect of the present invention is an electrical heating element including an outer sheath made of a titanium material, and an inner sheath made of a stainless steel material. The electrical heating element has an electrical resistance line disposed within the inner sheath, the electrical heating element including a dielectric powder disposed within the inner sheath around the electrical resistance line. The outer sheath and the inner sheath are tightly rolled to compress the dielectric powder around the electrical resistance line. The outer sheath fits tightly around the inner sheath in a state of tensile hoop stress.

Yet another aspect of the present invention is a spa system including a container adapted to hold water for immersion of a user. The spa system also includes an electrical water heater, a pump, and a fluid conduit system interconnecting the container, electrical water heater, and the pump to permit fluid flow through the spa system. The electrical water heater includes a generally tubular housing having a wall portion made of a titanium material, and an elongated electrical heating element having electrical connectors on opposite ends thereof extending through the wall portion. The electrical heating element has an outer sheath made of a titanium material, and an inner sheath made of a stainless steel material. The electrical heating element has an electrical resistance line disposed within the inner sheath and connected to the electrical connectors at opposite ends thereof. The electrical heating element includes a dielectric material disposed within the inner sheath around the electrical resistance line to facilitate heat transfer from the electrical resistance line to the inner sheath.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 3:
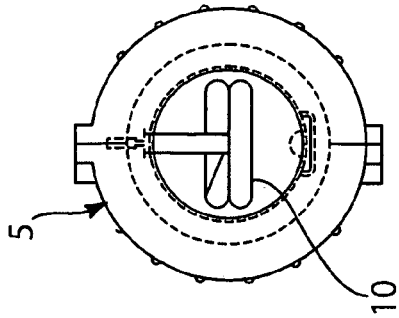
FIG. 3 is a right elevational view of the heater of FIG. 1.
Figure 2:
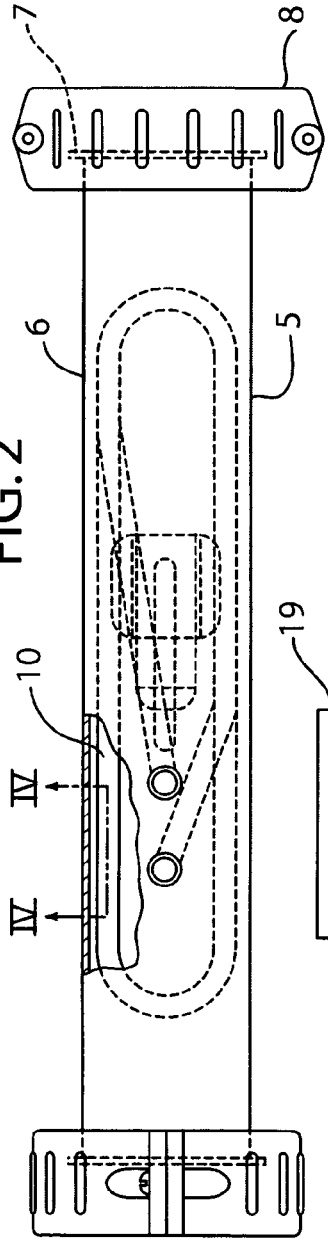
FIG. 2 is a partially fragmentary, top view of the electrical heater of FIG. 1.
Figure 1:
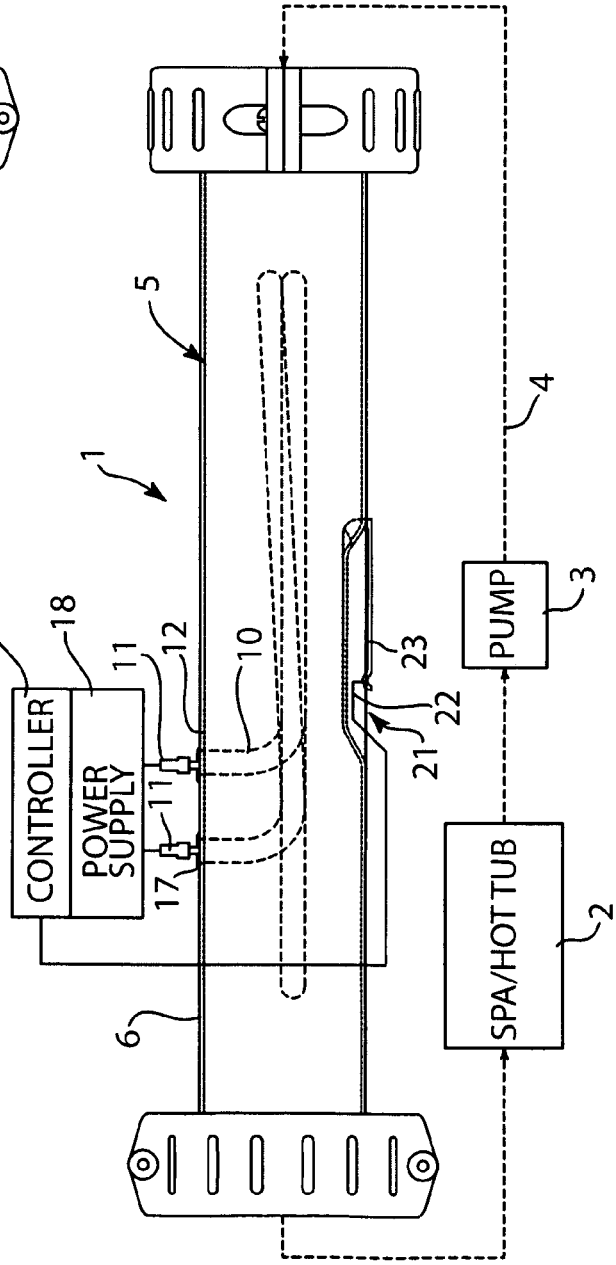
FIG. 1 is a partially schematic front elevational view of an electrical heater according to one aspect of the present invention.

For purposes of description herein, the terms "upper," "lower, " "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
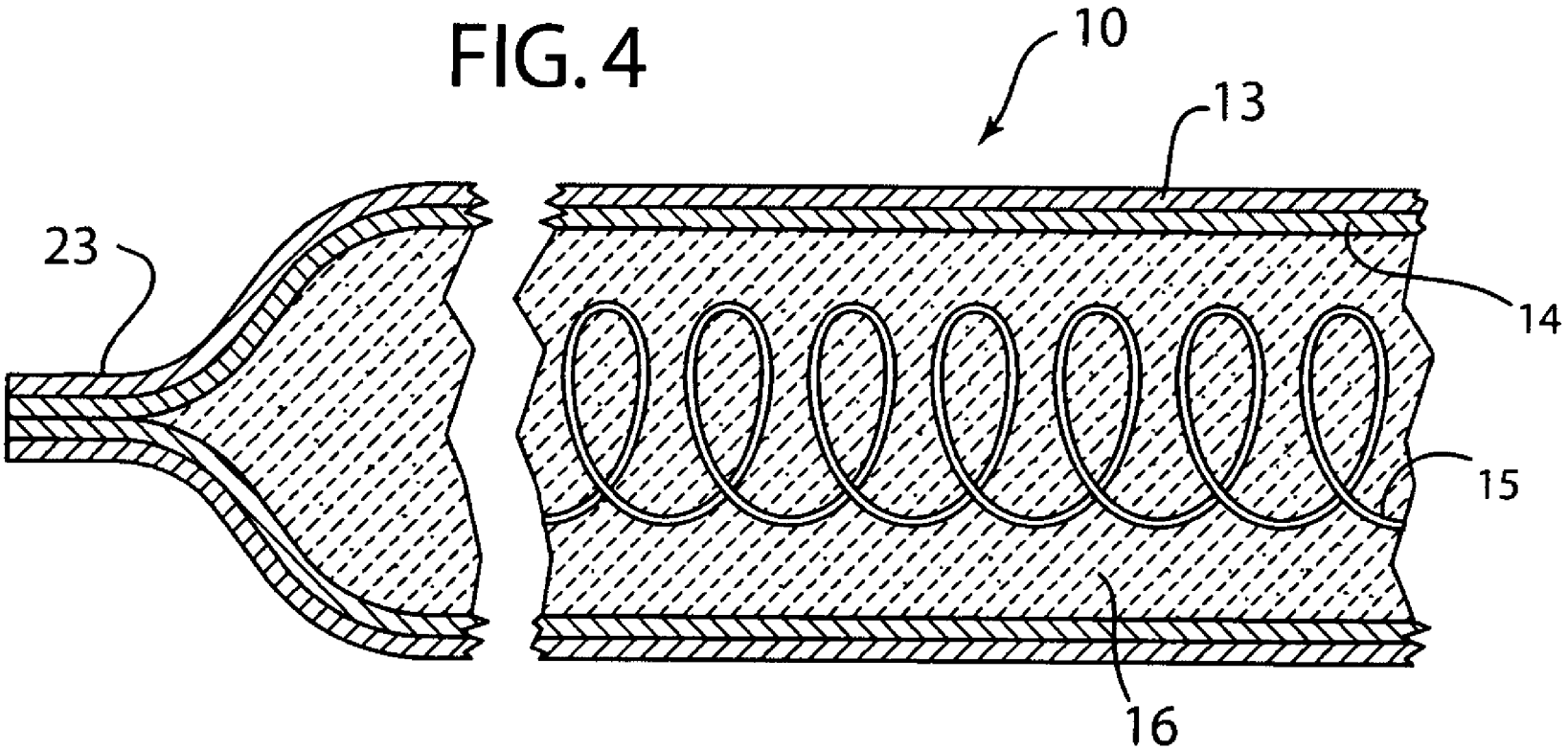
FIG. 4 is a cross-sectional view of the heating element of FIG. 2, taken along the line IV—IV.

With reference to FIG. 1, a spa system 1 according to one aspect of the present invention includes a pool/spa/hot tub 2, an electrical pump 3, an electrical heater 5, and tubing 4 interconnecting the components of the spa system to provide circulation of water therethrough. The electrical heater 5 includes a titanium tubular housing 6 having an outer diameter in the range of about 1-½ inches to 3 inches. In the illustrated example, tubular housing 6 has an outer diameter of 2.25 inches. Tubular housing 6 includes flanges 7 at opposite ends thereof to retain couplers 8 for connection to the tubing 4 or other spa components. An elongated electrical heating element 10 includes electrical connectors 11 that extend through a wall portion 12 of tubular housing 6. With further reference to FIG. 4, electrical heating element 10 has an outer sheath 13 made of a titanium material, and an inner sheath 14 made of a stainless steel material. An electrical resistance line 15 is made of a material such as nickel chromium, or the like, and is disposed within the inner sheath 14 and connected to the electrical connectors 11 at opposite ends thereof. The electrical heating element 10 includes a dielectric material such as magnesium oxide powder 16 disposed within the inner sheath 14 around the electrical resistance line 15 to facilitate heat transfer from the electrical resistance line 15 to the inner sheath 14, outer sheath 13, and the water flowing through the housing 6.

Electrical connectors 11 (FIG. 1) extend through flared openings 17 in tubular housing 6. Because the outer sheath 13 of electrical heating element 10 is made of a titanium material, the electrical heating element 10 can be welded at the flared openings 17 of housing 6, thereby providing a durable leakproof connection. The electrical connectors 11 are operably connected to a power supply 18 that receives signals from a connector 19. Housing 6 includes an indented portion 21 that receives a temperature sensor 20. The temperature sensor 20 is retained in the indentation 21 against the housing 6 by a flexible metal cover 22 that is tack welded to housing 6. The temperature sensor 20 is in contact with the housing 6, such that the temperature of the water flowing through the housing 6 can be sensed. Temperature sensor 20 is operatively connected to controller 19, and the controller 19 is programmed to control the electric heating element in a known manner. An example of one such arrangement is disclosed in U.S. Pat. No. 6,080,973 entitled "ELECTRIC WATER HEATER" filed on Apr. 19, 1999, the entire contents of which is hereby incorporated by reference.

With further reference to FIG. 4, the stainless steel inner sheath 14 is first fabricated with the electrical resistance wire 15 and dielectric material 16 disposed therein according to known methods. The titanium outer sheath or sleeve 13 is then placed over the stainless steel inner sheath 14 and roll reduced in a standard rolling mill to provide a tight fit resulting in a high rate of heat transfer between the inner sheath 14 and outer sheath 13. Prior to roll reduction, the end 23 of sheaths 13 and 14 is tightly crimped to eliminate relative motion between the sheaths 13 and 14 to ensure proper roll reduction. The roll reduction and tight fit of the outer sheath 13 causes the outer sheath 13 to experience hoop stress, thus ensuring that contact is maintained between the outer sheath 13 and inner sheath 14. The magnesium oxide or other powder 16 is tightly compacted to provide heat transfer from the electrical resistance heater line 15 to the inner sheath 14. Although the titanium outer sheath 13 will stress relief slightly at higher temperatures, such as 1000° F., the stainless steel inner sheath 14 will not stress relief in this manner, thereby maintaining the compaction of the dielectric material 16 and proper heat transfer. In a preferred example, stainless inner sheath 14 has a thickness of 0.020 inches, and outer titanium sheath 13 has a thickness of 0.035 inches. The inner sheath 14 and outer sheath 13 may have thicknesses in the range of about 0.015–0.050 inches.

Thus, the electric heating element 10 is very corrosion resistant, yet maintains proper heat transfer through the dielectric material 16. Furthermore, because the outer sheath 13 is made of a titanium material, the electric heating element 10 can be welded to the titanium housing 6, thus providing a secure, leakproof connection.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method of fabricating an electrical heating element, comprising:

providing an electrical resistance heating line;

placing the electrical resistance heating line in a stainless steel sheath;

positioning dielectric powder around the electrical resistance heating line;

placing a titanium sheath around the stainless steel sheath;

fixing the titanium sheath relative to the stainless steel sheath;

compacting the titanium and stainless steel sheaths to compress the dielectric powder around the heating line to tightly fit the outer titanium sheath around the stainless steel inner sheath.

2. The method of claim 1, wherein:

the titanium and stainless steel sheaths are compacted simultaneously.

3. The method of claim 1, wherein:

the titanium sheath is fixed relative to the stainless steel sheath prior to compaction of the titanium sheath and the stainless steel sheath.

4. The method of claim 1, wherein:

the titanium and stainless steel sheaths are compacted utilizing a roll forming process.

5. The method of claim 1, wherein:

the sheaths are compressed sufficiently to maintain compaction of the magnesium powder when the electrical heating element reaches a temperature of at least about one thousand degrees Fahrenheit.

6. The method of claim 1, wherein:

the inner and outer sheaths each have a generally circular cross sectional shape, and the inner surface of the outer sheath tightly contacts the outer surface of the inner sheath.

7. The method of claim 1, wherein:

the titanium sheath and the stainless steel sheath are deformed to fix the titanium sheath relative to the stainless steel sheath.

8. The method of claim 1, including:

securing electrical connectors to opposite ends of the heating element.

9. The method of claim 1, including:

providing a housing having a titanium housing; and welding the titanium outer sheath to the housing.

10. An electrical heater for fluid, comprising:

a housing having a wall portion defining a cavity and having a fluid inlet and a fluid outlet in fluid communication with the cavity to provide fluid flow through the cavity; and an elongated electrical heating element having opposite end portions extending through the wall portion and including electrical connectors outside of the housing, the electrical heating element having an outer sheath made of a titanium material, and an inner sheath made of a stainless steel material, the titanium outer sheath being tightly fitted around the stainless steel inner sheath, the electrical heating element further including an elongated electrical resistance line disposed within the inner sheath and connected to the electrical connectors at opposite ends of the elongated electrical resistance line, the electrical heating element including a substantially non-electrically conductive material disposed within the inner sheath around the electrical resistance line to facilitate heat transfer from the electrical resistance line to the inner sheath, the elongated electrical heating element including at least one U-shaped bend.

11. The electrical heater of claim 10, wherein:

the inner and outer sheaths have substantially circular cross-sectional shapes.

12. The electrical heater of claim 10, wherein:

the wall portion of the housing is made of a titanium material; and the outer sheath of the electrical heating element is welded to the wall portion of the tubular housing adjacent opposite ends of the electrical heating element.

13. The electrical heater of claim 12, wherein:

the wall portion includes a pair of openings therethrough that receive opposite end portions of the electrical heating element, wherein the openings are flared outwardly to form a contact surface engaging the outer sheath of the electrical heating element.

14. The electrical heater of claim 13, wherein:

the housing includes couplers on opposite ends thereof adapted for leakproof connection of the housing to associated spa components.

15. The electrical heater of claim 10, wherein:

the housing has a tubular construction and defines an axis; and the U-shaped bend of the electrical heating element includes spaced-apart portions that are substantially linear and parallel to the axis.

16. The electrical heater of claim 10, wherein:

the housing has a cylindrical outer surface having a diameter in the range of about one and one half inches to three inches; and the electrical heating element has a cylindrical outer surface having an outer diameter in the range of about two tenths of an inch to about one half inch.

17. The electrical heater of claim 1, wherein:

the non-electrically conductive material comprises a dielectric material.

18. The electrical heater of claim 17, wherein:

the dielectric material comprises magnesium powder.

19. The electrical heater of claim 10, wherein:

the wall portion of the housing is made of a titanium material.

20. The method of claim 1, including:

bending the electrical heating element to form a U-shaped bend.

* * * * *